United States Patent [19]

Meigs et al.

[11] 4,423,578

[45] Jan. 3, 1984

[54] THERMALLY BROKEN FRAME WITH SEPARATION PREVENTION

[75] Inventors: William Meigs; Horace B. McWhirter, II, both of Selma, Ala.

[73] Assignee: Disco Aluminum Products Co., Inc., Selma, Ala.

[21] Appl. No.: 384,068

[22] Filed: Jun. 1, 1982

[51] Int. Cl.[3] ..... E06B 3/26

[52] U.S. Cl. ..... 52/403; 29/410; 49/DIG. 1; 52/730

[58] Field of Search ..... 52/730, 403, 393; 49/DIG. 1, DIG. 2; 29/418, 458, 460

[56] References Cited

U.S. PATENT DOCUMENTS

| | | | |
|---|---|---|---|
| 3,212,179 | 10/1965 | Koblensky | 52/403 |
| 4,330,919 | 5/1982 | Bischlipp | 29/418 |

FOREIGN PATENT DOCUMENTS

| | | | |
|---|---|---|---|
| 47808 | 8/1978 | Fed. Rep. of Germany | 52/730 |
| 197811 | 11/1978 | Netherlands | 52/730 |

*Primary Examiner*—John E. Murtagh
*Assistant Examiner*—Kathryn Ford
*Attorney, Agent, or Firm*—Larson and Taylor

[57] ABSTRACT

A thermally broken frame having a plurality of bridging flanges to prevent separation of the frame members upon failure of the thermal breaking material is disclosed. A method of manufacturing such a thermally broken frame is also disclosed and includes the steps of producing a frame having the frame members connected by a long bridging flange, subsequently connecting the two frame members together with a thermal break material, and finally removing portions of the long bridging flange so that small remaining sections of the bridging flange remain to prevent separation of the frame members should the thermal break material fail. Preferably, the frame members and bridging flange are initially integrally formed and the thermal break material is anchored in both frames. Sections of the bridging flange are removed by cutters.

9 Claims, 1 Drawing Figure

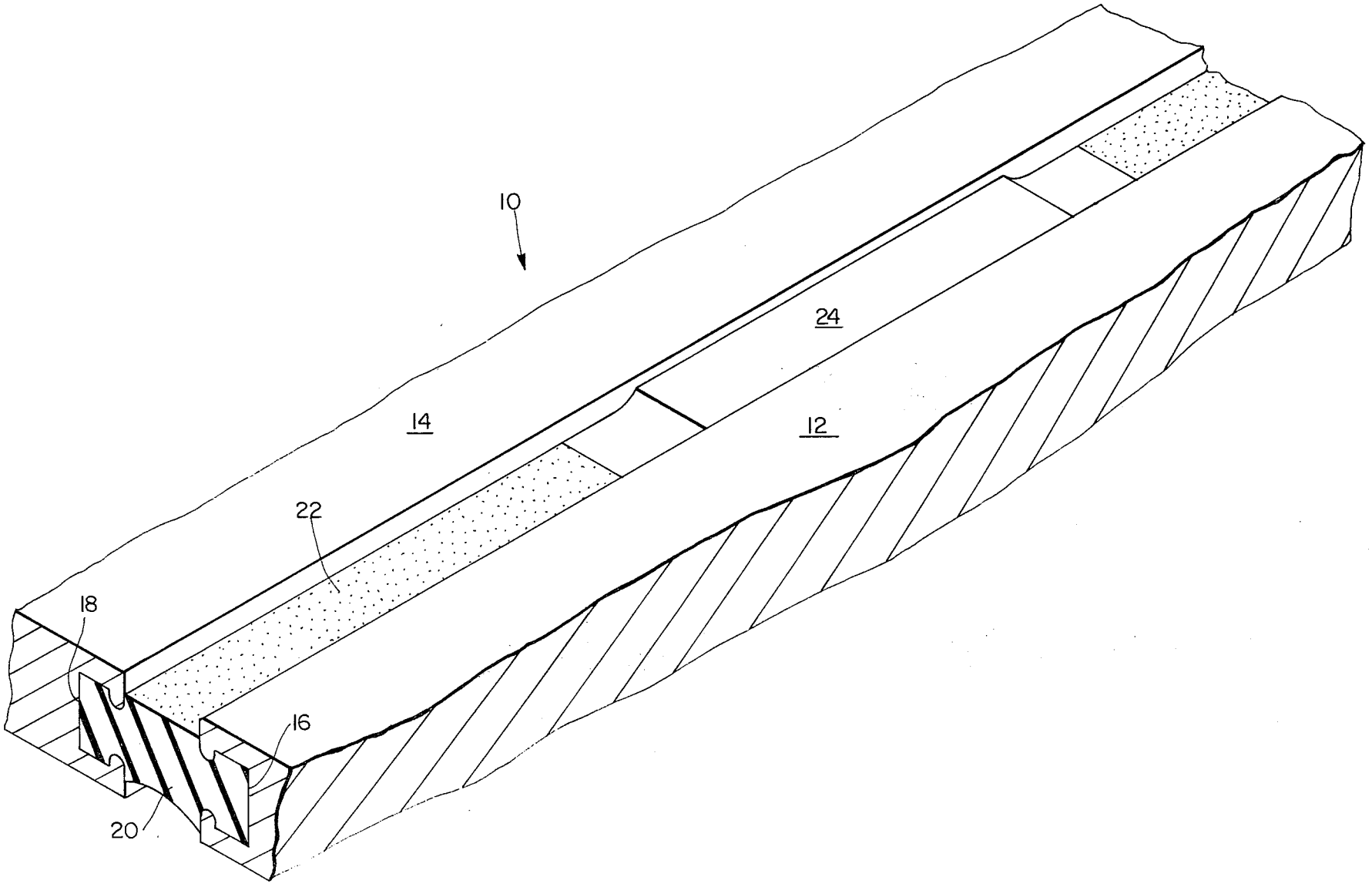
10
14
24
12
22
16
18
20

THERMALLY BROKEN FRAME WITH SEPARATION PREVENTION

FIELD OF THE INVENTION

This invention relates generally to a thermally broken frame and a method of manufacture thereof, and more particularly to a thermally broken frame with separation prevention.

BACKGROUND OF THE INVENTION

Frames, particularly for windows, have been disclosed in the prior art which are made of two frame members interconnected by a thermal break or barrier material. For example, in U.S. Pat. No. 4,275,526 (Abramson), a window frame encasing a glass panel is disclosed. The window frame is formed with a channel along its axial length in which a low thermal conductivity material is hardened in situ. A strip of the channel is removed to separate the two frame members so that they remain joined only by the low thermal conductivity material. Another patent disclosing two frame members that are connected by a thermal barrier material is disclosed in U.S. Pat. No. 3,916,503 (Chenevert et al). In this patent, the insulating barrier material is joined with the metal frames by mechanical means. A T-shaped thermal barrier with anchoring flanges which connects two frame members is disclosed in U.S. Pat. No. 3,878,660 (Jacob).

By connecting two frame members with a thermal insulating material, prior art devices such as those disclosed above have provided an energy efficient means for thermally insulating the exterior portion of a frame from the interior portion. However, in the event of structural failure of the thermal insulating material, due to fire or excessive heat, it has been found that the outer frame and glass fall away from each other so that a significant safety hazard is created. In order to prevent this, clips have been manually applied around the two frame members. Unfortunately, besides being difficult to apply during manufacture, such clips are unsightly and protrude from the smooth surface of the frame. In addition, such clips can be displaced and inadvertantly removed.

SUMMARY OF THE INVENTION

In accordance with the present invention, a thermally broken frame having an inner frame member and an outer frame member connected by a thermal break material is disclosed. In order to prevent separation of the two frame members where the thermal break material fails, a plurality of bridging flanges between the frame members are used. Preferably, the bridging flanges are formed by removing sections from a single long bridging flange. A method of manufacturing such a thermally broken frame is also disclosed.

In a preferred embodiment of the present invention, the inner frame member, outer frame member, and bridging flanges are integrally formed. In addition, the thermal break material is anchored in both the inner frame member and outer frame member. According to the method of the present invention, the sections are removed from the long bridging flange by cutting away with cutters.

Other features and advantages of the present invention are stated in or apparent from the detailed description of a presently preferred embodiment of the invention found herein below.

BRIEF DESCRIPTION OF THE DRAWING

The single FIGURE is a perspective view of a portion of a thermally broken frame according to the present invention.

DETAILED DESCRIPTION OF THE PREFERRED EMBODIMENT

With reference now to the drawing, a portion of a thermally broken frame 10, such as a frame for a window, is depicted. Frame 10 includes an inner frame member 12 and an outer frame member 14. Both frame members 12 and 14 have lipped channels 16 and 18, respectively, disposed along the mutually facing sides. Disposed in lipped channels 16 and 18 and serving to structurally connect frame members 12 and 14 is a thermal break material 20. As shown, thermal break material 20 is anchored in lipped channels 16 and 18. Thermal break material 20 has a relatively low thermal conductivity so that heat transfer from inner frame member 12 to outer frame member 14 is substantially reduced by maintaining frame members 12 and 14 separated from one another with thermal break material 20.

Thermal break material 20 holds frame members 12 and 14 separated by one another so that an elongate groove 22 is provided between frame members 12 and 14. Disposed at spaced intervals along the length of groove 22 is a small bridging flange 24. Preferably, bridging flange 24 is integrally formed with frame members 12 and 14, but is relatively small relative to the length of groove 22 such that the low heat transfer from inner frame member 12 to outer frame member 14 is substantially unaffected. For example, bridging flange 24 could be approximately two inches in length, and could be located in groove 22 approximately every twenty-four inches.

A method for manufacturing a thermally broken frame as described above is as follows. Initially, a single metal frame is provided having an inner frame member 12, an outer frame member 14, and a long bridging flange located in the position where groove 22 is to be located. Conveniently, such a frame can be made by extruding an aluminum metal so that inner frame member 12, outer frame member 14, and a long bridging flange are integrally formed. It should also be noted that inner frame member 12 and outer frame member 14 also include lipped channels 16 and 18 which are also easily formed by extruding.

Next, thermal break material 20 is used to connect inner frame member 12 and outer frame member 14 structurally together. Conveniently, thermal break material 20 is provided in liquid form so that it can then be hardened in situ. To accomplish this, thermal frame 10 is inverted from the orientation shown in the FIGURE and the thermal break material easily poured into the space between lipped channels 16 and 18 and left there to harden in situ. After hardening, thermal break material 20 is anchored in lipped channels 16 and 18 so that inner frame member 12 and outer frame member 14 are structurally held together.

After thermal break material 20 has hardened in place, one or more small bridging flanges 24 are formed by removing sections of the long bridging flange provided in groove 22 to thereby form groove 22. Conveniently, the portions of the long bridging flange are removed by cutting away with cutters. Such an operation is easily performed by raising and lowering the cutter at predetermined intervals.

In use, thermally broken frame 10 provides a sturdy frame for a window or the like in which the outer frame member 14 is thermally insulated from the inner frame member 12. Should thermally broken frame 10 be subject to a fire or excessive heat such that thermal break material 20 fails (i.e., melts, burns off, or vaporizes), bridging flanges 24 connecting inner frame member 12 and outer frame member 14 continue to hold thermally broken frame 10 together. Without bridging flanges 24, upon loss of thermal break material 20, outer frame member 14 could separate from inner frame member 12 and pose a safety hazard.

While the present invention has been described with respect to an exemplary embodiment thereof, it will be understood by those of ordinary skill in the art that many variations and modifications can be effected within the scope and spirit of the invention.

What is claimed is:

1. A method of manufacturing a thermally broken frame in which the separation of the inner and outer frame members due to a failure of the thermal break material is prevented, comprising the steps of:

producing a frame having an inner frame member and an outer frame member spaced from one another and connected by a long bridging flange;

connecting the inner frame member and the outer frame member together with a thermal break material along the length of the frame members; and removing the bridging flange at intervals along the length of the frame such that the frame is substantially a thermally broken frame with the thermal break material connecting the inner frame member and the outer frame member and such that the small remaining sections of bridging flange prevent separation of the inner frame member and outer frame member where the thermal break material fails.

2. A method of manufacturing a thermally broken frame as claimed in claim 1 wherein the inner frame member, the outer frame member, and the bridging flange are integrally formed of metal.

3. A method of manufacturing a thermally broken frame as claimed in claims 1 or 2 wherein the thermal break material is anchored at one longitudinal side of the inner frame member and is anchored at the other longitudinal side of the outer frame member.

4. A method of manufacturing a thermally broken frame as claimed in claim 3 wherein the bridging flange is removed at equally spaced intervals.

5. A method of manufacturing a thermally broken frame as claimed in claim 4 wherein the bridging flange is removed at intervals by cutting away with cutters.

6. A thermally broken frame comprising:

an inner elongate frame member made of metal;

an outer elongate frame member made of metal;

a thermal break material for structurally connecting said inner frame member and said outer frame member together along the lengths thereof; and a plurality of bridging flanges which are integrally formed with said inner and outer frame members and which are located at spaced intervals along the lengths of said inner and outer frame members, said integrally formed connector members serving to hold said inner frame member and said outer frame member together where said thermal break material fails.

7.A thermally broken frame comprising:

an inner elongate metal frame member;

an outer elongate metal frame member;

a thermal break material for structurally connecting said inner frame member and said outer frame member together along the lengths thereof; and a plurality of short bridging flanges located at spaced intervals for connecting said inner frame member and said outer frame member, said plurality of short bridging flanges being formed by removing sections from a single long bridging flange which connected said inner frame member and said outer frame member after said thermal break material is in place such that upon failure of said thermal break material, said plurality of short bridging flanges prevent separation of said inner frame member and said outer frame member.

8. A thermally broken frame as claimed in claim 7 wherein said inner frame member, said outer frame member, and said plurality of short bridging flange are integrally formed.

9. A thermally broken frame as claimed in claims 7 or 8 wnerein said thermal break material is anchored at one longitudinal side in said inner frame member and is anchored at the other longitudinal side in said outer frame member.

* * * * *